US006976638B2

(12) United States Patent
Matz et al.

(10) Patent No.: US 6,976,638 B2
(45) Date of Patent: Dec. 20, 2005

(54) FUEL INJECTION SYSTEM FOR AN INTERNAL COMBUSTION ENGINE

(75) Inventors: Katja Matz, Ludwigsburg (DE); Uwe Schmidt, Vaihingen/Enz (DE); Hubert Greif, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/467,379

(22) PCT Filed: Nov. 2, 2002

(86) PCT No.: PCT/DE02/04075

§ 371 (c)(1),
(2), (4) Date: Jan. 26, 2004

(87) PCT Pub. No.: WO03/050408

PCT Pub. Date: Jun. 19, 2003

(65) Prior Publication Data

US 2004/0123840 A1 Jul. 1, 2004

(30) Foreign Application Priority Data

Dec. 7, 2001 (DE) ..... 101 60 263

(51) Int. Cl.[7] ..... B05B 9/00
(52) U.S. Cl. ..... 239/124; 239/88; 239/89; 239/91; 239/533.2; 239/533.3; 123/446; 123/447
(58) Field of Search ..... 239/124, 88–92, 239/96, 533.2, 533.3, 533.9; 123/446, 447

(56) References Cited

U.S. PATENT DOCUMENTS 5,826,562 A 10/1998 Chen et al.
5,860,597 A * 1/1999 Tarr ..... 239/124
6,168,132 B1 * 1/2001 Frank et al. ..... 251/33
6,494,383 B2 * 12/2002 Augustin ..... 239/124
6,502,555 B1 * 1/2003 Harcombe et al. ..... 123/467
6,631,853 B2 * 10/2003 Lenk et al. ..... 239/90
6,758,417 B2 * 7/2004 Buck ..... 239/533.2
6,779,741 B2 * 8/2004 Boehland ..... 239/88
6,789,743 B2 * 9/2004 Baranowski et al. ..... 239/124

FOREIGN PATENT DOCUMENTS

EP 0 987 431 3/2000
EP 1 088 985 4/2001
EP 1088985 A2 * 4/2001 ..... F02M 47/02
WO WO 01 14712 A 3/2001

* cited by examiner

*Primary Examiner*—David A. Scherbel
*Assistant Examiner*—James S. Hogan
(74) *Attorney, Agent, or Firm*—Ronald E. Greigg

(57) ABSTRACT

A fuel injection system having one high-pressure fuel pump and one fuel injection valve communicating therewith for each engine cylinder. A piston of the fuel pump defines a work chamber which communicates with a pressure chamber of the fuel injection valve, which valve has an injection valve member by which injection openings are controlled, and which valve is movable in an opening direction counter to a closing force by the pressure prevailing in the pressure chamber. A first control valve controls, a connection of the pump work chamber to a relief chamber and a second control valve controls, a connection of a control pressure chamber, communicating with the pump work chamber and defined by a control piston, to a relief chamber. The control piston, controls a flow cross section of the connection of the control pressure chamber to the relief chamber as a function of the stroke of the control piston in such a way that when the injection valve member is in a closing direction, a larger flow cross section is uncovered than when the injection valve member is disposed in an open position.

19 Claims, 3 Drawing Sheets

FUEL INJECTION SYSTEM FOR AN INTERNAL COMBUSTION ENGINE

CROSS-REFERENCE TO RELATED APPLICATIONS

This application is a 35 USC 371 application of PCT/DE 02/04075 filed on Nov. 2, 2002.

BACKGROUND OF THE INVENTION

1. Field of the Invention

The invention is directed to an improved fuel injection system for an internal combustion engine.

2. Description of the Prior Art

One fuel injection system of the type with which this invention is concerned is known from European Patent Disclosure EP 0 987 431 A2. For each cylinder of the engine, this fuel injection system has one high-pressure fuel pump and one fuel injection valve communicating with it. The high-pressure fuel pump has a pump piston, which defines a pump work chamber and is driven in a reciprocating motion by the engine. The fuel injection valve has a pressure chamber communicating with the pump work chamber and also has an injection valve member, by which at least one injection opening is controlled and which is movable by the pressure prevailing in the pressure chamber in the opening direction, counter to a closing force, to uncover the at least one injection opening. A first electrically actuated control valve is provided, by which a connection of the pump work chamber to a relief chamber is controlled. A second electrically actuated control valve is also provided, by which a connection of a control pressure chamber to a relief chamber is controlled. The control pressure chamber communicates with the pump work chamber via a throttle restriction. The control pressure chamber is defined by a control piston, which is braced on the injection valve member and is urged in the closing direction of the injection valve member by the pressure prevailing in the control pressure chamber. For a fuel injection, the first control valve is closed and the second control valve is opened, so that high pressure cannot build up in the control pressure chamber, and the fuel injection valve can open. With the second control valve open, however, fuel flows out of the pump work chamber via the control pressure chamber, so that of the fuel quantity pumped by the pump piston, the fuel quantity that is available for injection is reduced, and the pressure available for the injection is also reduced. As a consequence, the efficiency of the fuel injection system is not optimal.

SUMMARY AND ADVANTAGES OF THE INVENTION

The fuel injection system of the invention has the advantage over the prior art that when the second control valve is open for the fuel injection and the fuel injection valve is thus also open, only a small flow cross section from the control pressure chamber to the relief chamber is uncovered, and thus only a small fuel quantity flows out; as a result, the available pressure for the injection and the efficiency of the fuel injection system are enhanced. At the onset or end of the fuel injection, fast opening and closure of the fuel injection valve is moreover achieved, which is made possible by a fast pressure reduction or pressure buildup, occurring because of the variable flow cross section, in the control pressure chamber upon opening and closure of the second control valve.

Advantageous features and refinements of the fuel injection system of the invention are disclosed. One embodiment makes the control of the flow cross section possible in a simple way. Another embodiment enables a simple formation of the bypass connection. A further embodiment makes a simple formation of the bypass connection possible that is furthermore not vulnerable to possible soiling, since when the fuel injection valve is closed the groove is open, and dirt particles can accordingly not stick in it.

BRIEF DESCRIPTION OF THE DRAWINGS

The invention will be more fully described herein below in conjunction with the drawings, in which.

DESCRIPTION OF THE PREFERRED EMBODIMENT

Figure 1:
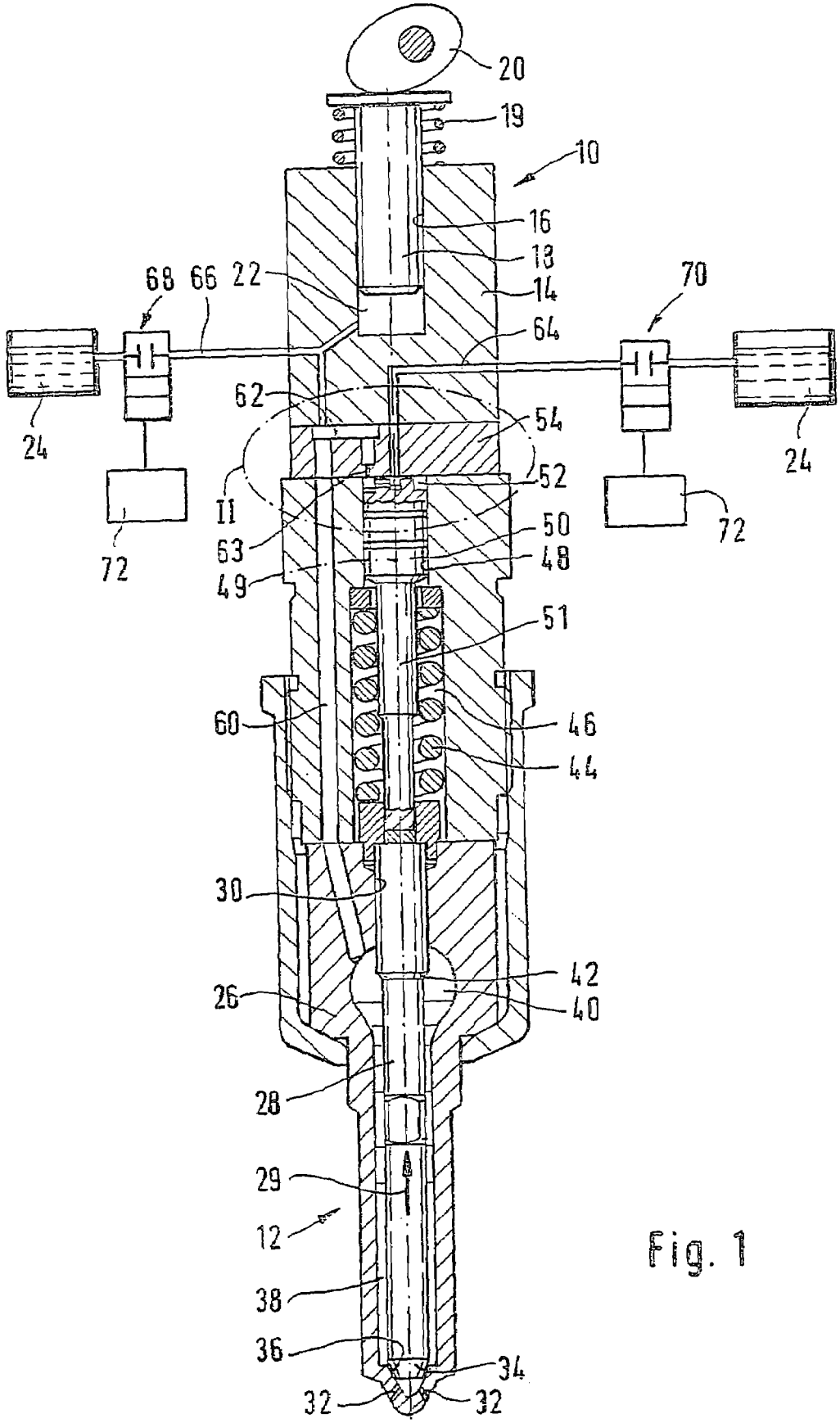
FIG. 1 shows a fuel injection system for an internal combustion engine in a longitudinal section in a simplified illustration.

In FIGS. 1–6, a fuel injection system for an internal combustion engine of a motor vehicle is shown. The engine is preferably a self-igniting internal combustion engine. The fuel injection system is preferably embodied as a so-called unit fuel injector, and for each cylinder of the engine it has one high-pressure fuel pump 10 and one fuel injection valve 12, communicating with it, which form a common structural unit. Alternatively, the fuel injection system can be embodied as a so-called pump-line-nozzle system, in which the high-pressure fuel pump and the fuel injection valve of each cylinder are disposed separately from one another and communicate with one another via a line. The high-pressure fuel pump 10 has a pump body 14 with a cylinder bore 16, in which a pump piston 18 is tightly guided that is driven in a reciprocating motion at least indirectly by a cam 20 of an engine camshaft counter to the force of a restoring spring 19. In the cylinder bore 16, the pump piston 18 defines a pump work chamber 22, in which fuel is compressed at high pressure in the pumping stroke of the pump piston 18. Fuel from a fuel tank 24 of the motor vehicle is supplied to the pump work chamber 22.

The fuel injection valve 12 has a valve body 26, which is connected to the pump body 14 and can be embodied in multiple parts, and in which an injection valve member 28 is guided longitudinally displaceably in a bore 30. The valve body 26, in its end region toward the combustion chamber of the cylinder of the engine, has at least one and preferably a plurality of injection openings 32. The injection valve member 28, in its end region toward the combustion chamber, has a sealing face 34, which for instance is approximately conical, and which cooperates with a valve seat 36 embodied in the valve body 26, in its end region toward the combustion chamber; injection openings 32 lead away from the valve seat or downstream of it. In the valve body 26, between the injection valve member 28 and the bore 30, there is an annular chamber 38 toward the valve seat 36; the annular chamber, in its end region remote from the valve seat 36, changes over as a result of a radial enlargement of the bore 30 into a pressure chamber 40 surrounding the injection valve member 28. At the level of the pressure chamber 40, as a result of a cross-sectional reduction, the injection valve member 28 has a pressure shoulder 42. The end of the injection valve member 28 remote from the combustion chamber is engaged by a prestressed closing spring 44, by which the injection valve member 28 is pressed toward the valve seat 36. The closing spring 44 is disposed in a spring chamber 46 of the valve body 26 that adjoins the bore 30.

The spring chamber 46 is adjoined, on its end remote from the bore 30, in the valve body 26 by a further bore 48, in which a control piston 50 that is connected to the injection valve member 28 is guided tightly. The bore 48 forms a control pressure chamber 52, which is defined by the control piston 50, as a movable wall. Via a piston rod 51 of smaller diameter than the control piston, the control piston 50 is braced on the injection valve member 28 and may be joined to the injection valve member 28. The control piston 50 may be embodied in one piece with the injection valve member 28, but for reasons of assembly it is preferably joined as a separate part to the injection valve member 28.

From the pump work chamber 22, according to FIG. 1, a conduit 60 leads through the pump body 14 and the valve body 26 to the pressure chamber 40 of the fuel injection valve 12. A conduit 62 leads from the pump work chamber 22, or from the conduit 60, to the control pressure chamber 52. A conduit 64 that forms a connection to a relief chamber, which the fuel tank 24 or some other region can serve as at least indirectly and in which a low pressure prevails, also discharges into the control pressure chamber 52. A connection 66 leads away from the pump work chamber 22 or from the conduit 60 to a relief chamber 24, which is controlled by a first electrically actuated control valve 68. The control valve 68 may, as shown in FIG. 1, be embodied as a 2/2-way valve. The connection 64 of the control pressure chamber 52 to the relief chamber 24 is controlled by a second electrically actuated control valve 70, which may be embodied as a 2/2-way valve. A throttle restriction 63 is provided in the connection 62 of the control pressure chamber 52 to the pump work chamber 22. The control valves 68, 70 may have an electromagnetic actuator or a piezoelectric actuator and are triggered by an electronic control unit 72.

Between the pump body 14 of the high-pressure fuel pump 10 and the valve body 26 of the fuel injection valve 12, a shim 54 is disposed that forms a boundary of the control pressure chamber 52, on the side thereof remote from the injection valve member 28. The face 53 of the shim 54 defining the control pressure chamber 52 is disposed at least approximately perpendicular to the longitudinal axis 49 of the control piston 50. The conduit 62 from the conduit 60 to the control pressure chamber 52 is embodied in the shim 54, and the throttle restriction 63 is embodied as a throttle bore in the shim 54. The throttle bore 63 discharges into a peripheral region of the control pressure chamber 52, offset from the longitudinal axis 49 of the control piston 50. In the shim 54, there is a bore 55, which forms part of the connection 64 of the control pressure chamber 52 to the relief chamber 24.

Figure 2:
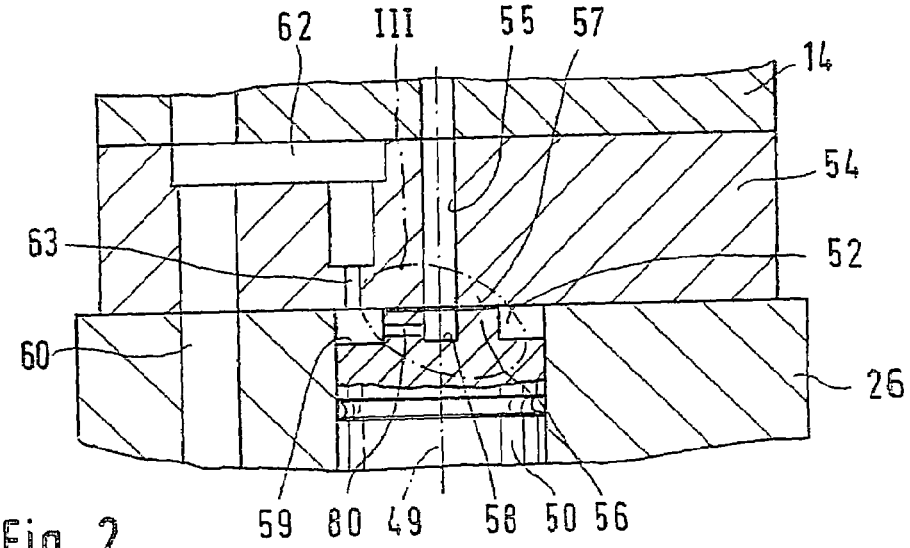
FIG. 2 shows an enlarged detail marked II in FIG. 1.

As shown in FIG. 2, the control piston 50, on its face end toward the shim 54, has a hollow-cylindrical extension 56, which has a smaller diameter than the control piston 50, in the region of the control piston that is guided tightly in the bore 48. An annular sealing face 57 is embodied on the end face of the extension 56 oriented toward the shim 54. There is accordingly an indentation 58 inside the extension 56, and outside the extension 56, an annular countersunk region 59 extending around the extension is formed on the control piston 50. The indentation 58 is disposed at least approximately coaxially to the bore 55 in the shim 54 and has at least approximately the same diameter as the bore 55. The sealing face 57 can be embodied as at least approximately plane and can extend perpendicular to the longitudinal axis 49 of the control piston 50. However, the sealing face 57 is preferably chamfered in such a way that it drops away radially inward toward the indentation 58, as shown in FIGS. 3–6. The throttle bore 63 in the shim 54 discharges into the control pressure chamber 52 outside the extension 56 of the control piston 50, in the region of the countersunk region 59. The bore 55 in the shim 54 forms an outlet, leading away inside the extension 56 of the control piston 50, to the second control valve 70 and, by way of this control valve, to the relief chamber 24.

Figure 3:
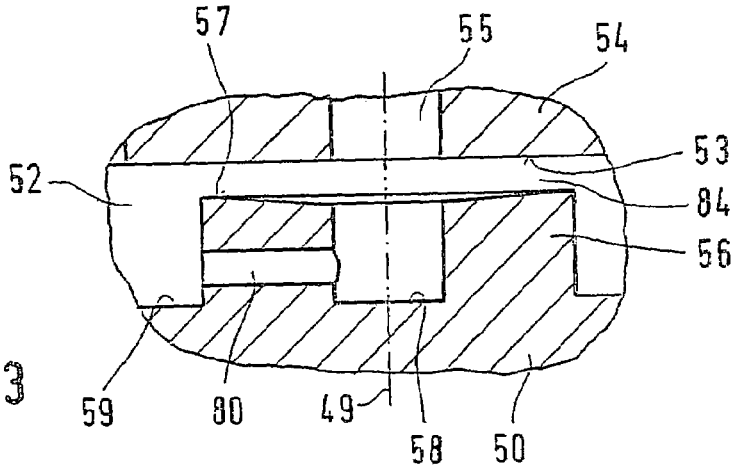
FIG. 3 shows a further-enlarged detail III of FIG. 2 with the fuel injection valve closed.
Figure 4:
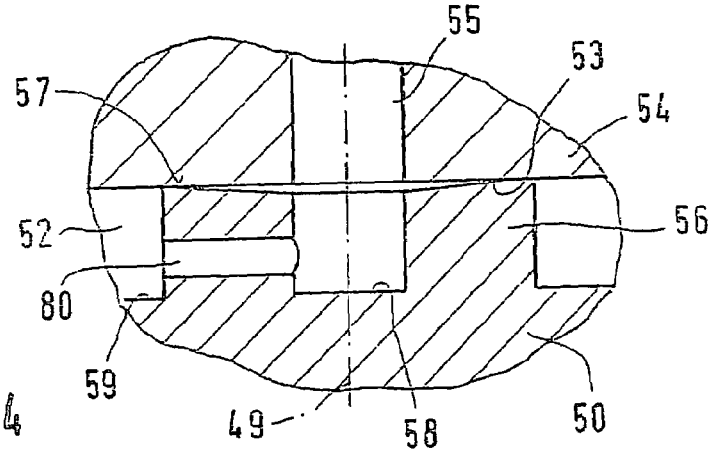
FIG. 4 shows the detail III with the fuel injection valve open.

In a version of the fuel injection system shown in FIGS. 2–4, a throttle bore 80 is disposed in the hollow-cylindrical extension 56 of the control piston 50; this bore connects the countersunk region 59, outside the extension 56, to the indentation 58 inside the extension 56. The throttle bore 80 for example extends approximately radially to the longitudinal axis 49 of the control piston 50 through the extension 56. When the fuel injection valve 12 is closed, the injection valve member 28 is in a closing position, in which it rests with its sealing face 34 on the valve seat 36 and closes the injection openings 32. The control piston 50 is correspondingly in a reciprocating position at that time, in which with its sealing face 57 it is spaced apart from the face 53 of the shim 54 that forms the boundary of the control pressure chamber 52, as shown in FIG. 3. Between the sealing face 57 of the control piston 50 and the face 53 of the shim 54, a large flow cross section 84 is thus uncovered for the connection 64 of the control pressure chamber 52 to the second control valve 70. The inflow of fuel into the control pressure chamber 52 from the conduit 60 via the conduit 62 and the throttle bore 63 is defined by the throttle bore 63. The outflow of fuel from the control pressure chamber 52 to the second control valve 70, however, is effected without throttling, via the large flow cross section that is uncovered by the primary connection 84 between the sealing face 57 of the control piston 50 and the shim 54, whereupon the throttle bore 80 in the control piston 50 is then inoperative.

When the fuel injection valve 12 is open, the injection valve member 28 is in an open position, in which it is spaced apart with its sealing face 34 from the valve seat 36 and uncovers the injection openings 32. The control piston 50 is correspondingly then in a reciprocating position, in which it rests with its sealing face 57 on the face 53 of the shim 54, as shown in FIG. 4. The face 53 of the shim 54 thus forms a valve seat, with which the sealing face 57 of the control piston 50 cooperates. Because of the chamfering of the sealing face 57, the sealing face rests essentially only with its outer edge on the face 53 of the shim 54, and as a result the linear contact with high pressure per unit of surface area and thus secure sealing is attained. Between the sealing face 57 of the control piston 50 and the shim 54 as a valve seat, the primary connection 84 from the control chamber 52 to the bore 55 in the shim 54 is controlled for the communication of the control pressure chamber 52 with the second control valve 70 and with the relief chamber 24. When the fuel injection valve 12 is closed, this primary connection 84 is open, while it is closed when the fuel injection valve 12 is open. When the control piston 50 rests with its sealing face 57 on the face 53 of the shim 54 and closes the primary connection 84, a bypass connection from the control pressure chamber 52 to the bore 55 is opened via the throttle bore 80 in the control piston 50; the flow cross section of this bypass connection is determined by the throttle bore 80 and is substantially smaller than the flow cross section of the primary connection 84 when the primary connection is open.

Figure 5:
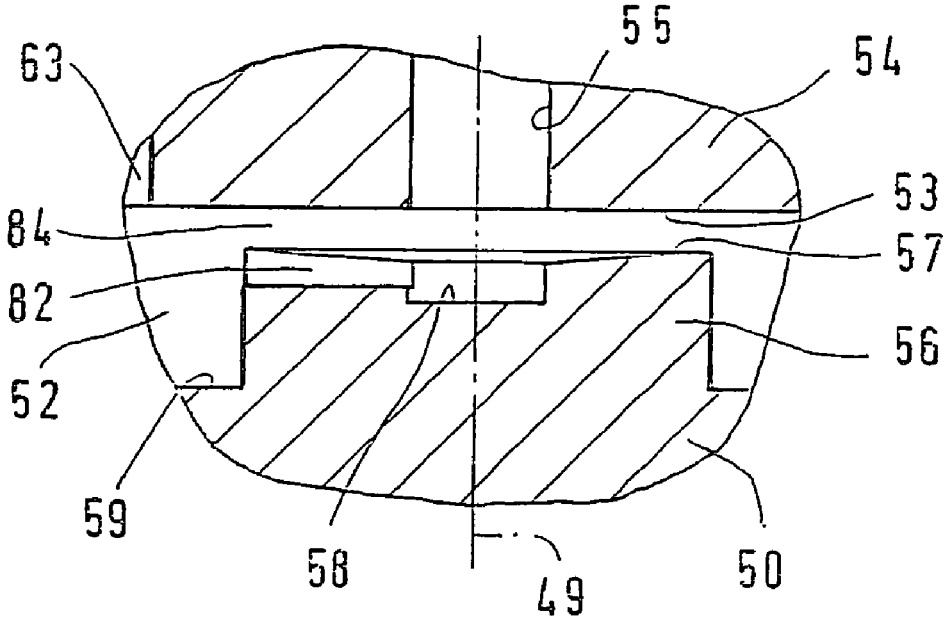
FIG. 5 shows the detail III of a fuel injection system in a modified version, with the fuel injection valve closed.
Figure 6:
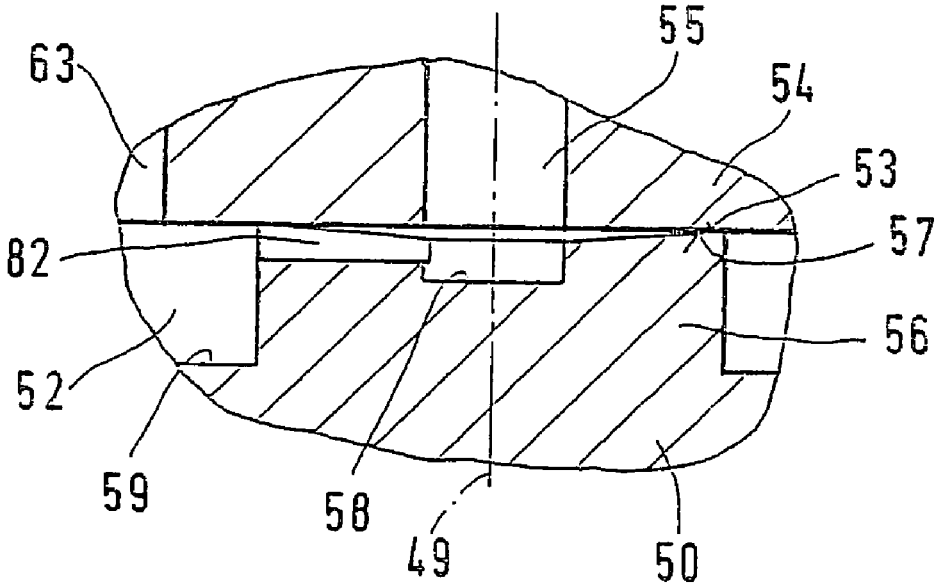
FIG. 6 shows the detail III with the fuel injection valve open.

In a modified version of the fuel injection system shown in FIGS. 5 and 6, instead of the throttle bore 80 in the control piston 50, a groove 82 is embodied in the sealing face 57; this groove for instance extends approximately radially to the longitudinal axis 49 of the control piston 50 and is open toward the shim 54. The cross section of the groove 82 can be arbitrary, and the groove 82 connects the countersunk region 59, outside the extension 56, to the indentation 58 inside the extension 56 of the control piston 50. When the fuel injection valve 12 is closed and the control piston 50 is spaced apart with its sealing face 57 from the face 53 of the shim 54, as shown in FIG. 5, the primary connection 84 to the bore 55 is uncovered with a large flow cross section by the control piston 50, and the throttle groove 82 is inoperative. When the fuel injection valve 12 is open and the control piston 50 rests with its sealing face 57 on the face 53 of the shim 54, as shown in FIG. 6, the primary connection 84 is closed by the control piston 50, and only the bypass connection via the throttle groove 82 of small flow cross section is uncovered. When the control piston 50 with its sealing face 57 is spaced apart from the face 53 of the shim 54, the groove 82 is open, so that any dirt particles that may be present cannot stick inside the groove and reduce the specified cross section and cause an impairment of the function of the fuel injection system.

The cross section of the throttle bore 63 in the shim 54 and of the throttle bore 80 or of the throttle groove 82 in the control piston 50 are adapted to one another in a suitable way for optimal function of the fuel injection system.

The function of the fuel injection system will now be explained. In the intake stroke of the pump piston 18, fuel is supplied to it from the fuel tank 24. In the pumping stroke of the pump piston 18, the fuel injection begins with a preinjection, in which the first control valve 68 is closed by the control unit 72, so that the pump work chamber 22 is disconnected from the relief chamber 24. The second control valve 70 is moreover opened by the control unit 72, so that the control pressure chamber 52 communicates with the relief chamber 24. In that case, high pressure cannot build up in the control pressure chamber 52, since the control pressure chamber is relieved toward the relief chamber 24. When the pressure in the pump work chamber 22 and thus in the pressure chamber 40 of the fuel injection valve 12 is so high that the pressure force exerted by it on the injection valve member 28 is greater than the sum of the force of the closing spring 44 and the pressure force exerted by the residual pressure in the control pressure chamber 52 on the control piston 50, then the injection valve member 28 moves in the opening direction 29 and uncovers the at least one injection opening 32. In the process, the control piston assumes its reciprocating position shown in FIGS. 4 and 6, so that now only the bypass connection is uncovered via the throttle bore 80 or the throttle groove 82 of small flow cross section. Of the fuel pumped by the pump piston 18, thus only a slight fraction can flow out into the relief chamber 24 via the throttle bore 63 and the throttle bore 80 or the throttle groove 82 and the opened second control valve 70. Provision can also be made for the fuel injection valve 12 to open for the preinjection with only a partial stroke of the injection valve member 28, so that the control piston 50, with its sealing face 57, does not come into contact with the shim 54, and thus does not close the primary connection entirely, but the flow cross section of the primary connection is reduced.

To terminate the preinjection, the second control valve 70 is closed by the control unit, so that the control pressure chamber 52 is disconnected from the relief chamber 24. The first control valve 68 remains in its closed position. High pressure thus builds up in both the control pressure chamber 52 and the pump work chamber 22, so that a high pressure force acts in the closing direction on the control piston 50, and the injection valve member 28 is moved into its closing position.

For an ensuing main injection, the second control valve 70 is opened by the control unit 72. The fuel injection valve 12 then opens in response to the reduced pressure force on the control piston 50, and the injection valve member 28, via its maximum opening stroke, moves into its open position. In the opening motion of the injection valve member 28, the large flow cross section across the primary connection 84 is first uncovered by the control piston 50, until the injection valve member 28 is opened with its maximum opening stroke, and the control piston 50 rests with its sealing face 57 on the face 53 of the shim 54 and closes the primary connection 84, and now only the bypass connection is uncovered via the throttle bore 80 or the throttle groove 82. As a result, faster opening of the fuel injection valve 12 is made possible. Once the fuel injection valve 12 is fully open, then via the throttle bore 63 and the throttle bore 80 or the throttle groove 82, now only a slight fuel quantity can flow away to the relief chamber 24, so that only a small portion of the fuel pumped by the pump piston 18 is unavailable for the injection.

To terminate the main injection, the second control valve 70 is put in its closed switching position by the control unit 72, so that the control pressure chamber 52 is disconnected from the relief chamber 24, and high pressure builds up in it, and via the force exerted on the control piston 50, the fuel injection valve 12 is closed. In the closing motion of the injection valve member 28, by means of the control piston 50, the primary connection 84 having the large flow cross section is uncovered, so that the pressure in the control pressure chamber 52 rapidly rises, and a high pressure force acts on the control piston 50, so that the fuel injection valve 12 closes quickly. For a postinjection of fuel, the second control valve 70 is opened once again by the control unit 72, so that as a consequence of the reduced pressure in the control pressure chamber 52, the fuel injection valve 12 opens. For terminating the postinjection, the second control valve 70 is closed and/or the first control valve 68 is opened.

The foregoing relates to preferred exemplary embodiments of the invention, it being understood that other variants and embodiments thereof are possible within the spirit and scope of the invention, the latter being defined by the appended claims.

What is claimed is:

1. In a fuel injection system for an internal combustion engine, the system comprising one high-pressure fuel pump (10) and one fuel injection valve (12) communicating with it, for each cylinder of the engine, the high-pressure fuel pump (10) having a pump piston (18) driven in a reciprocating motion by the engine and defining a pump work chamber (22), to which fuel is supplied from a fuel tank (24), the fuel injection valve (12) having a pressure chamber (40), communicating with the pump work chamber (22), and an injection valve member (28) by which at least one injection opening (32) is controlled and which is urged in an opening direction (29) on a pressure face (42), embodied on it, by the pressure prevailing in the pressure chamber (40), the injection valve member being movable counter to a closing force in the opening direction (29) to uncover the at least one injection opening (32), a first control valve (68), by which a first connection (66) of the pump work chamber (22) to a relief chamber (24) is controlled, a second control valve (70), by which a second connection (64) of a control pressure chamber (52) of the fuel injection valve and a relief chamber (24) is controlled, the control pressure chamber (52) at least indirectly having a third connection (62) to the pump work chamber (22) in which a throttle restriction (63) is located, the control pressure chamber (52) being defined by a control piston (50), which acts in a closing direction on the injection valve member (28), the control piston (50) being movable to control a flow cross section of the second connection (64) of the control pressure chamber (52) to the relief chamber (24) as a function of the stroke of the control piston (50) whereby when the injection valve member (28) is disposed in a closed position, a larger flow cross section of the second connection (64) is uncovered than when injection valve member (28) is disposed in an open position, wherein the control piston (50), when the injection valve member (28) disposed in its closed position, uncovers a primary connection (84) of large flow cross section; and wherein when the injection valve member (28) is disposed in its open position, the control piston (50) closes the primary connection, so that only a bypass connection (80; 82) of small flow cross section is uncovered.

2. The fuel injection system of claim 1, wherein the bypass connection is formed by a throttle bore (80) in the control piston (50).

3. The fuel injection system of claim 2, wherein the control piston (50), on its face end remote from the injection valve member (28), has a sealing face (57), with which the control piston cooperates with a valve seat (53), the sealing face (57) being embodied at a boundary (54) of the control pressure chamber (52), for controlling the primary connection (84).

4. The fuel injection system of claim 3, wherein the valve seat is formed by a face (53) of the boundary (54) of the control pressure chamber (52), which face is disposed at least approximately perpendicular to the longitudinal axis (49) of the control piston (50).

5. The fuel injection system of claim 3, wherein the control piston (50) has a hollow-cylindrical extension (56) toward the boundary (54), which extension has a smaller cross section than the rest of the control piston (50); wherein the sealing face (57) is disposed on the face end of the extension (56); wherein the bypass connection (80; 82) penetrates the extension (56) of the control piston (50); and wherein by means of the boundary (54), an outlet (55) leading away inside the extension (56) of the control piston (50) is provided as part of the second connection (64) of the control pressure chamber (52) and the relief chamber (24).

6. The fuel injection system of claim 2, wherein the high-pressure fuel pump (10) and the fuel injection valve (12) form a common structural unit; and that the boundary (54) of the control pressure chamber (52) is formed by a shim disposed between a pump body (14) of the high-pressure fuel pump (10) and a valve body (26) of the fuel injection valve (12).

7. The fuel injection system of claim 1, wherein the control piston (50), on its face end remote from the injection valve member (28), has a sealing face (57), with which the control piston cooperates with a valve seat (53), the sealing face (57) being embodied at a boundary (54) of the control pressure chamber (52), for controlling the primary connection (84).

8. The fuel injection system of claim 7, wherein the valve seat is formed by a face (53) of the boundary (54) of the control pressure chamber (52), which face is disposed at least approximately perpendicular to the longitudinal axis (49) of the control piston (50).

9. The fuel injection system of claim 8, wherein the control piston (50) has a hollow-cylindrical extension (56) toward the boundary (54), which extension has a smaller cross section than the rest of the control piston (50); wherein the sealing face (57) is disposed on the face end of the extension (56); wherein the bypass connection (80; 82) penetrates the extension (56) of the control piston (50); and wherein by means of the boundary (54), an outlet (55) leading away inside the extension (56) of the control piston (50) is provided as part of the second connection (64) of the control pressure chamber (52) and the relief chamber (24).

10. The fuel injection system of claim 8, wherein the high-pressure fuel pump (10) and the fuel injection valve (12) form a common structural unit; and that the boundary (54) of the control pressure chamber (52) is formed by a shim disposed between a pump body (14) of the high-pressure fuel pump (10) and a valve body (26) of the fuel injection valve (12).

11. The fuel injection system of claim 7, wherein the control piston (50) has a hollow-cylindrical extension (56) toward the boundary (54), which extension has a smaller cross section than the rest of the control piston (50); wherein the sealing face (57) is disposed on the face end of the extension (56); wherein the bypass connection (80; 82) penetrates the extension (56) of the control piston (50); and wherein by means of the boundary (54), an outlet (55) leading away inside the extension (56) of the control piston (50) is provided as part of the second connection (64) of the control pressure chamber (52) and the relief chamber (24).

12. The fuel injection system of claim 11, wherein the high-pressure fuel pump (10) and the fuel injection valve (12) form a common structural unit; and that the boundary (54) of the control pressure chamber (52) is formed by a shim disposed between a pump body (14) of the high-pressure fuel pump (10) and a valve body (26) of the fuel injection valve (12).

13. The fuel injection system of claim 7, wherein the high-pressure fuel pump (10) and the fuel injection valve (12) form a common structural unit; and that the boundary (54) of the control pressure chamber (52) is formed by a shim disposed between a pump body (14) of the high-pressure fuel pump (10) and a valve body (26) of the fuel injection valve (12).

14. The fuel injection system of claim 1, wherein the high-pressure fuel pump (10) and the fuel injection valve (12) form a common structural unit; and that the boundary (54) of the control pressure chamber (52) is formed by a shim disposed between a pump body (14) of the high-pressure fuel pump (10) and a valve body (26) of the fuel injection valve (12).

15. In a fuel injection system for an internal combustion engine, the system comprising one high-pressure fuel pump (10) and one fuel injection valve (12) communicating with it, for each cylinder of the engine, the high-pressure fuel pump (10) having a pump piston (18) driven in a reciprocating motion by the engine and defining a pump work chamber (22), to which fuel is supplied from a fuel tank (24), the fuel injection valve (12) having a pressure chamber (40), communicating with the pump work chamber (22), and an injection valve member (28) by which at least one injection opening (32) is controlled and which is urged in an opening direction (29) on a pressure face (42), embodied on it, by the pressure prevailing in the pressure chamber (40), the injection valve member being movable counter to a closing force in the opening direction (29) to uncover the at least one injection opening (32), a first control valve (68), by which a first connection (66) of the pump work chamber (22) to a relief chamber (24) is controlled, a second control valve (70), by which a second connection (64) of a control pressure chamber (52) of the fuel injection valve and a relief chamber (24) is controlled, the control pressure chamber (52) at least indirectly having a third connection (62) to the pump work chamber (22) in which a throttle restriction (63) is located, the control pressure chamber (52) being defined by a control piston (50), which acts in a closing direction on the injection valve member (28), the control piston (50) being movable to control a flow cross section of the second connection (64) of the control pressure chamber (52) to the relief chamber (24) as a function of the stroke of the control piston (50) whereby when the injection valve member (28) is disposed in a closed position, a larger flow cross section of the second connection (64) is uncovered than when injection valve member (28) is disposed in an open position, wherein the control piston (50), when the injection valve member (28) disposed in its closed position, uncovers a primary connection (84) of large flow cross section; and wherein when the injection valve member (28) is disposed in its open position, the control piston (50) closes the primary connection, so that only a bypass connection (80; 82) of small flow cross section is uncovered, wherein the bypass connection is formed by a throttle groove (82), which is disposed in an end face (57), remote from the injection valve member (28), of the control piston (50), and with this end face (57), when the injection valve member (28) is in its open position, the control piston comes into contact with a boundary (54) of the control pressure chamber (52).

16. The fuel injection system of claim 15, wherein the control piston (50), on its face end remote from the injection valve member (28), has a sealing face (57), with which the control piston cooperates with a valve seat (53), the sealing face (57) being embodied at a boundary (54) of the control pressure chamber (52), for controlling the primary connection (84).

17. The fuel injection system of claim 16, wherein the valve seat is formed by a face (53) of the boundary (54) of the control pressure chamber (52), which face is disposed at least approximately perpendicular to the longitudinal axis (49) of the control piston (50).

18. The fuel injection system of claim 16, wherein the control piston (50) has a hollow-cylindrical extension (56) toward the boundary (54), which extension has a smaller cross section than the rest of the control piston (50); wherein the sealing face (57) is disposed on the face end of the extension (56); wherein the bypass connection (80; 82) penetrates the extension (56) of the control piston (50); and wherein by means of the boundary (54), an outlet (55) leading away inside the extension (56) of the control piston (50) is provided as part of the second connection (64) of the control pressure chamber (52) and the relief chamber (24).

19. The fuel injection system of claim 15, wherein the high-pressure fuel pump (10) and the fuel injection valve (12) form a common structural unit; and that the boundary (54) of the control pressure chamber (52) is formed by a shim disposed between a pump body (14) of the high-pressure fuel pump (10) and a valve body (26) of the fuel injection valve (12).

* * * * *